US006899658B1

(12) United States Patent
Chuang

(10) Patent No.: US 6,899,658 B1
(45) Date of Patent: May 31, 2005

(54) STEPPING EXERCISER HAVING ROTATABLE MECHANISM

(76) Inventor: Jin Chen Chuang, P.O. Box 63-99, Taichung (TW) 406

( * ) Notice: Subject to any disclaimer, the term of this patent is extended or adjusted under 35 U.S.C. 154(b) by 0 days.

(21) Appl. No.: 10/724,295

(22) Filed: Nov. 25, 2003

(51) Int. Cl.[7] ..... A63B 22/04
(52) U.S. Cl. ..... 482/53
(58) Field of Search ..... 482/51–53, 70, 482/79–80

(56) References Cited

U.S. PATENT DOCUMENTS

| | | | | |
|---|---|---|---|---|
| 5,545,111 A | | 8/1996 | Wang et al. | 482/53 |
| 5,628,709 A | * | 5/1997 | Chen | 482/53 |
| 5,800,313 A | * | 9/1998 | Yu | 482/53 |
| 5,888,175 A | * | 3/1999 | Chang | 482/53 |
| 6,102,833 A | | 8/2000 | Chen | 483/53 |
| 6,224,515 B1 | | 5/2001 | Chen | 482/53 |
| 6,315,697 B1 | | 11/2001 | Chen | 482/53 |
| 6,582,344 B2 | | 6/2003 | Tang | 482/53 |

* cited by examiner

*Primary Examiner*—Stephen R. Crow
(74) *Attorney, Agent, or Firm*—Charles E. Baxley

(57) ABSTRACT

A stepping exerciser includes a base having a seat, a follower rotatably attached to the base and having an axle and a shaft, two foot supports rotatably attached to the follower with the axle and rotatable up and down relative to the base, and rotatable relative to the base together with the follower. Two actuators are rotatably attached to the follower with the shaft and coupled to the foot supports, and each includes a pole for engaging with the seat of the base, to force the follower to rotate relative to the base when the actuators are caused to rotate relative to the shaft of the follower by the foot supports.

10 Claims, 8 Drawing Sheets

STEPPING EXERCISER HAVING ROTATABLE MECHANISM

BACKGROUND OF THE INVENTION

1. Field of the Invention

The present invention relates to a stepping exerciser, and more particularly to a stepping exerciser having a rotatable mechanism for operating rotating or swinging or twisting operation while conducting stepping exercises.

2. Description of the Prior Art

Typical stepping exercisers comprise a pair of foot supports movable up and down relative to a base, for conducting stepping exercises. The typical foot supports may not be rotated or swung or twisted relative to the base.

Recently, several kinds of rotatable stepping exercisers have been developed and comprise a pair of foot supports rotatable or swingable or twistable relative to the base while conducting the typical stepping exercises.

For example, U.S. Pat. No. 5,545,111 to Wang et al. discloses one of the typical stepping exercises, and comprise a pair of foot supports coupled to a handle. Each of the foot supports includes a downrod extended therefrom for engaging with links, to rotate or swing or twist the foot supports relative to the base while conducting the typical stepping exercises.

Normally, while stepping, it is preferable that the foot supports move outwardly relative to the base when the foot supports are moved or stepped downwardly relative to the base. However, In Wang et al., while stepping down the foot supports, the foot supports may be rotated or twisted or moved inwardly relative to the base. This movement contradicts to the typical stepping exercises, such that the users may not easily operate the typical stepping exercises.

Similarly, in U.S. Pat. No. 6,102,833 to Chen, U.S. Pat. No. 6,224,515 to Chen, and U.S. Pat. No. 6,315,697 to Chen disclose three further typical stepping exercises, and also comprise a pair of foot supports each having a downrod extended therefrom for engaging with the base, such that the foot supports may also be rotated or twisted or moved inwardly relative to the base while stepping down the foot supports, and such that the users also may not easily operate the typical stepping exercises.

U.S. Pat. No. 6,582,344 to Tang discloses another typical stepping exercise comprising a pair of foot supports rotatably coupled to a gear of a base, to allow the foot supports to be rotated or twisted relative to the base while conducting the typical stepping exercises. However, the gears may be easily damaged after use.

The present invention has arisen to mitigate and/or obviate the afore-described disadvantages of the conventional stepping exercisers.

SUMMARY OF THE INVENTION

The primary objective of the present invention is to provide a stepping exerciser including a rotatable mechanism for operating smoothly rotating or swinging or twisting operation while conducting stepping exercises.

In accordance with one aspect of the invention, there is provided a stepping exerciser comprising a base including a seat provided thereon, a follower rotatably attached to the base, and including an axle and a shaft extended therefrom, two foot supports rotatably attached to the follower with the axle, and rotatable up and down relative to the base, and rotatable relative to the base together with the follower, two actuators rotatably attached to the follower with the shaft, and rotatable relative to the base together with the follower, each of the actuators including a pole extended therefrom for engaging with the seat of the base, to force the follower to rotate relative to the base when the actuators are caused to rotate relative to the shaft of the follower, and means for coupling the foot supports to the actuators, to rotate the actuators relative to the shaft of the follower when the foot supports are rotated up and down relative to the base.

The coupling means includes two levers extended from the actuators respectively, and two links coupled between the foot supports and the actuators respectively, to allow the actuators to be rotated relative to the shaft of the follower by the foot supports.

The seat of the base is preferably inclined toward the follower. The base includes a pad engaged onto the seat, for engaging with the pole of the actuator.

A resistive device may further be provided for providing resistive force against the foot supports. Two handles may further be provided and detachably attached to the follower.

The follower includes two arms attached to the shaft, to support the handles respectively. Each of the arms includes a bracket rotatably attached to the shaft. Each of the arms includes an opening formed therein to receive the handles respectively. Each of the arms includes a bar coupled to the foot supports.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
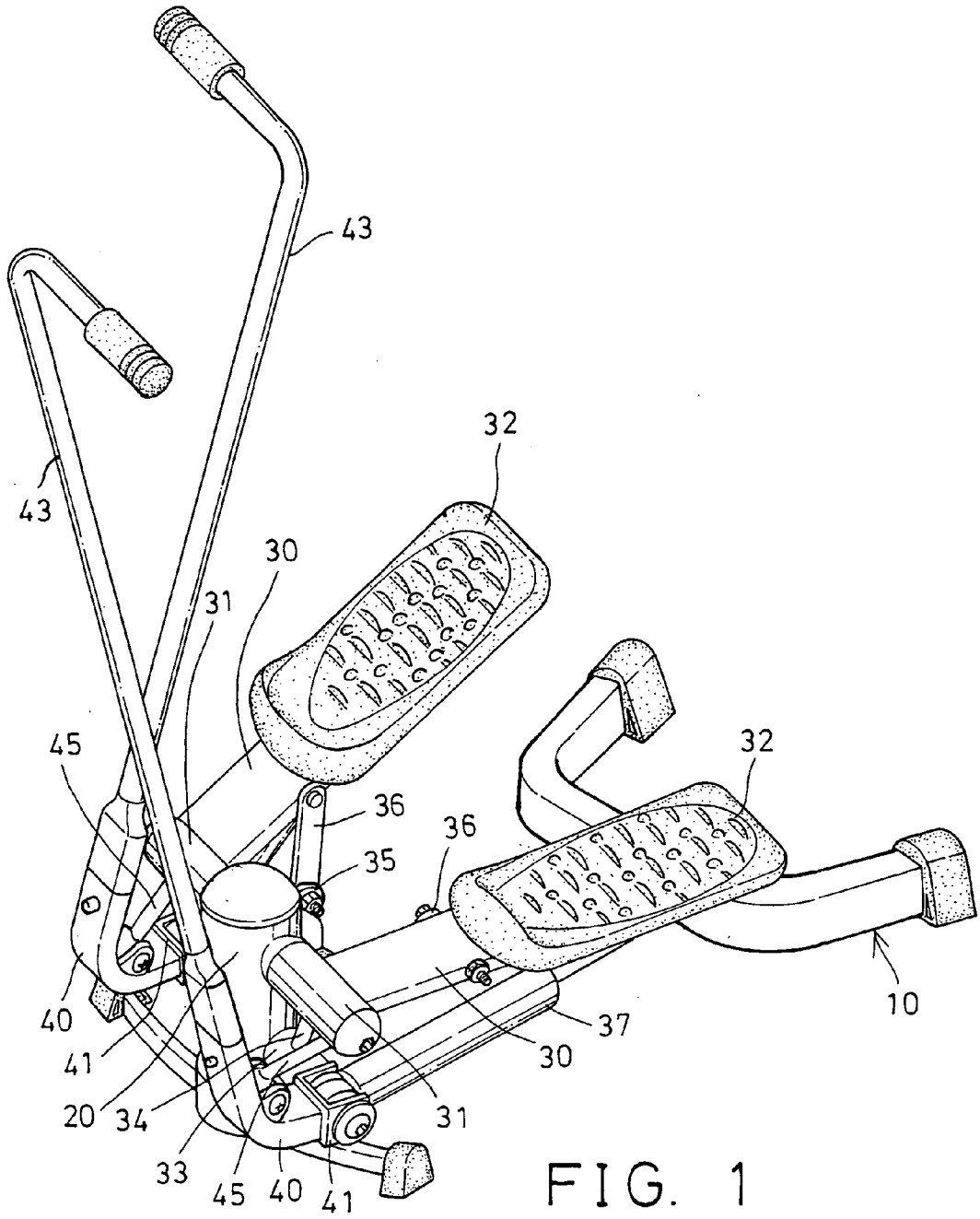
FIG. 1 is a perspective view of a stepping exerciser in accordance with the present invention.
Figure 2:
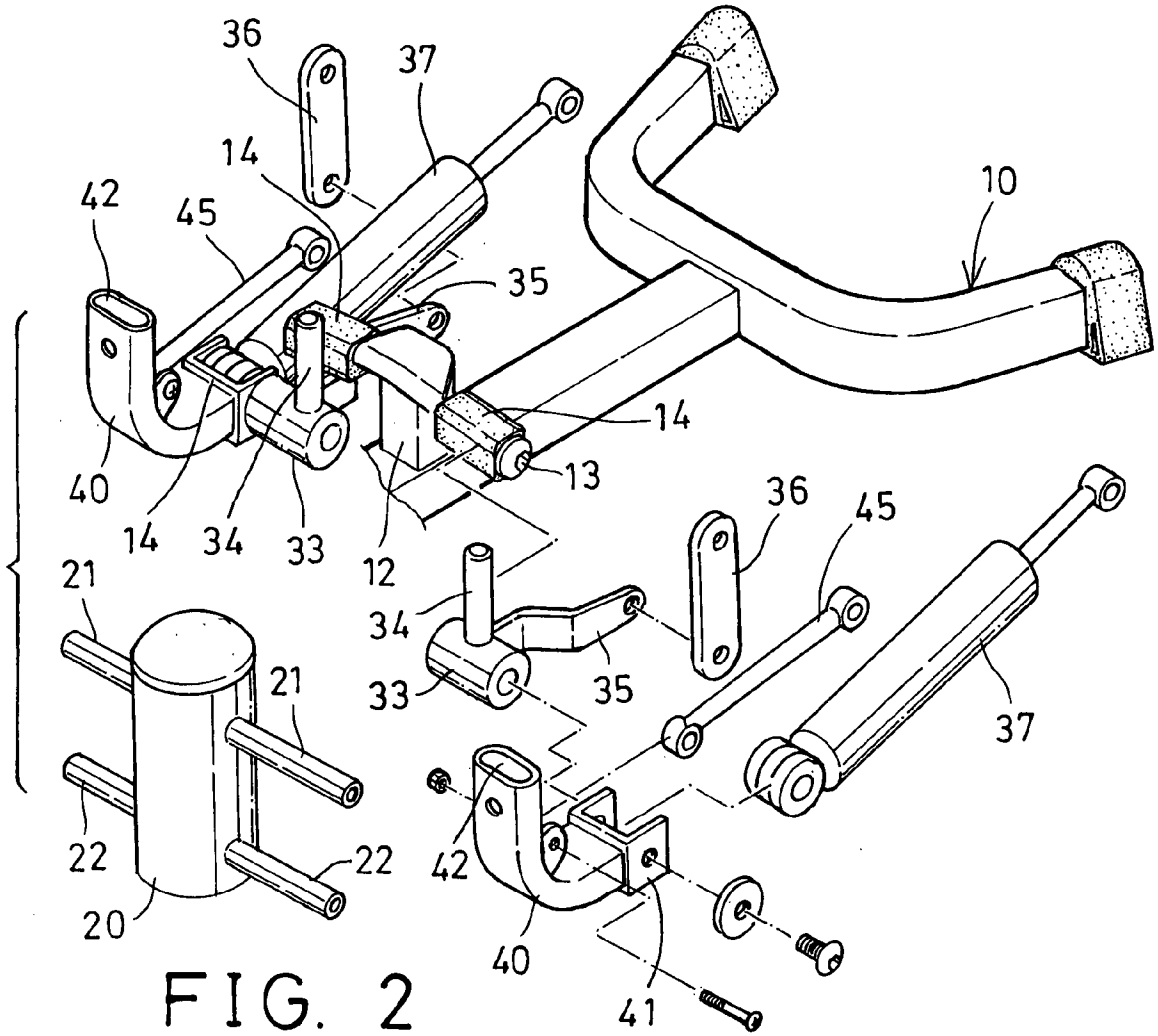
FIG. 2 is a partial exploded view of the stepping exerciser.
Figure 3:
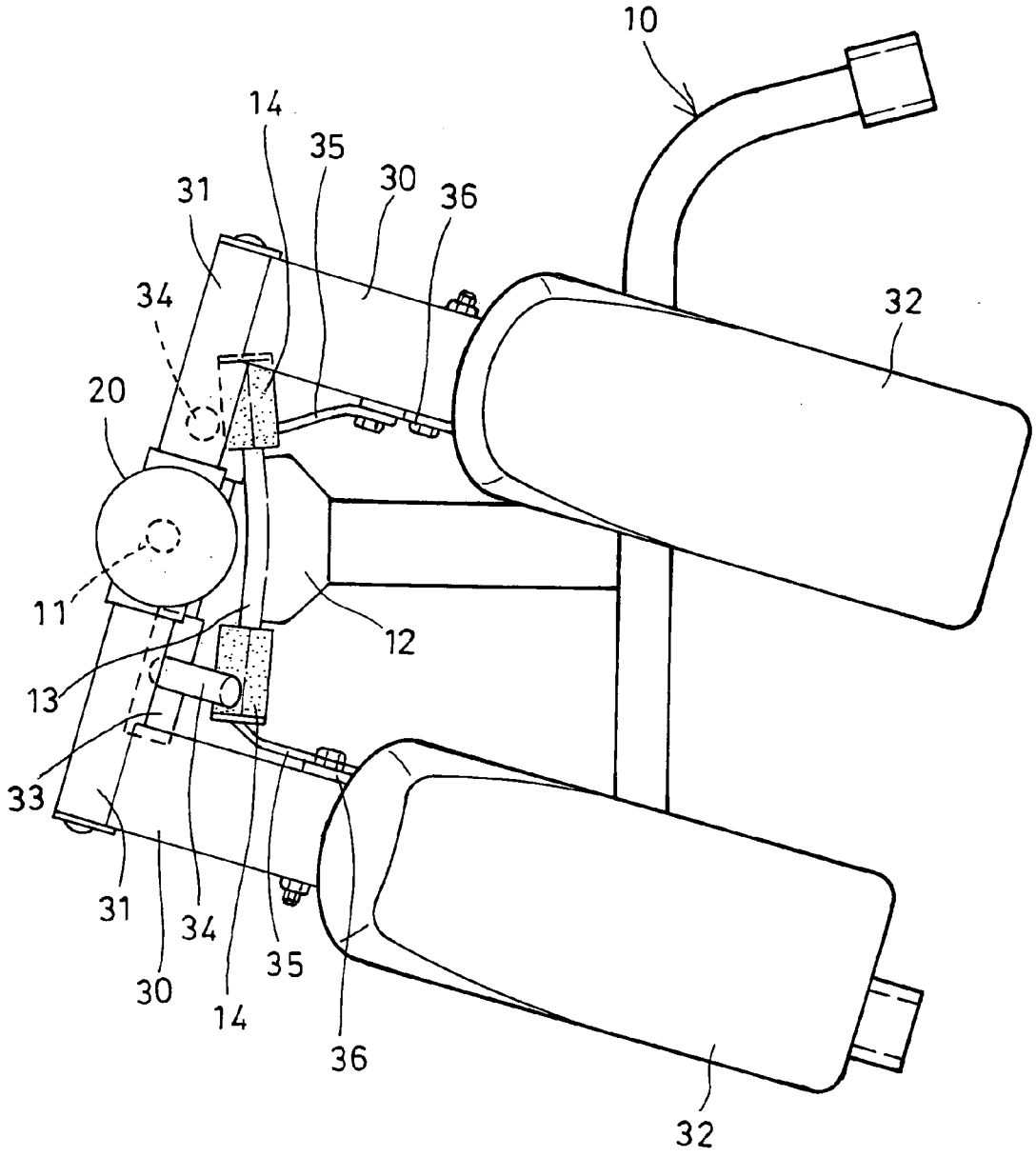
FIG. 3 is a top plan view of the stepping exerciser.

Referring to the drawings, and initially to FIGS. 1–3, a stepping exerciser in accordance with the present invention comprises a base 10, a follower 20 rotatably attached to the base 10 with such as a hub (not shown) or a spindle 11 (FIGS. 3, 4), to allow the follower 20 to be rotated relative to the base 10.

The follower 20 includes one or two axles 21 and one or two shafts 22 laterally extended therefrom, and preferably parallel to each other. The axles 21 may be formed as a one-integral axle or two separated axles extended from the follower 20. Similarly, The shafts 22 may also be formed as a one-integral shaft or two separated shafts extended from the follower 20.

Two foot supports 30 each includes a front portion 31 rotatably attached to the axles 21, to allow the foot supports 30 to be moved up and down relative to the base 10 about the axles 21, and to be rotated relative to the base 10 together with the follower 20, about the spindle 11. Each of the foot supports 30 includes a foot pedal 32 disposed on the rear portion thereof to support the users.

Two actuators 33 are rotatably attached to the shafts 22, to allow the foot pedals 32 to be rotated relative to the base 10 about the shafts 22, and to be rotated relative to the base 10 together with the follower 20, about the spindle 11. Each of the actuators 33 includes a pole 34 extended upwardly therefrom, and a lever 35 extended rearwardly therefrom.

Figure 5:
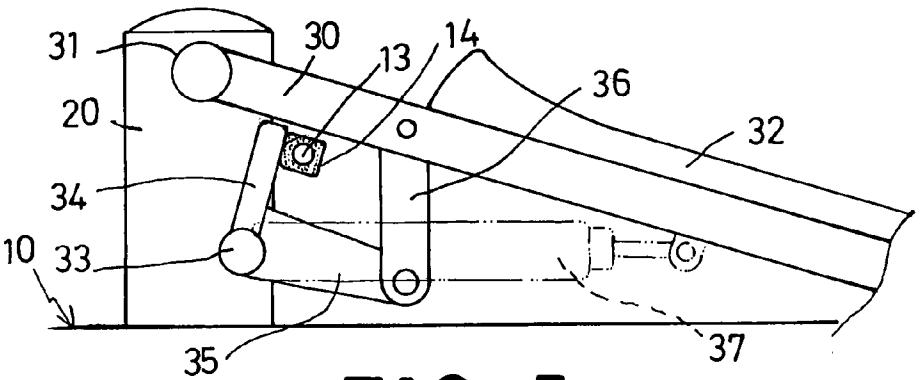
FIGS. 5, 6 are side schematic views illustrating the operation of the stepping exerciser.
Figure 6:
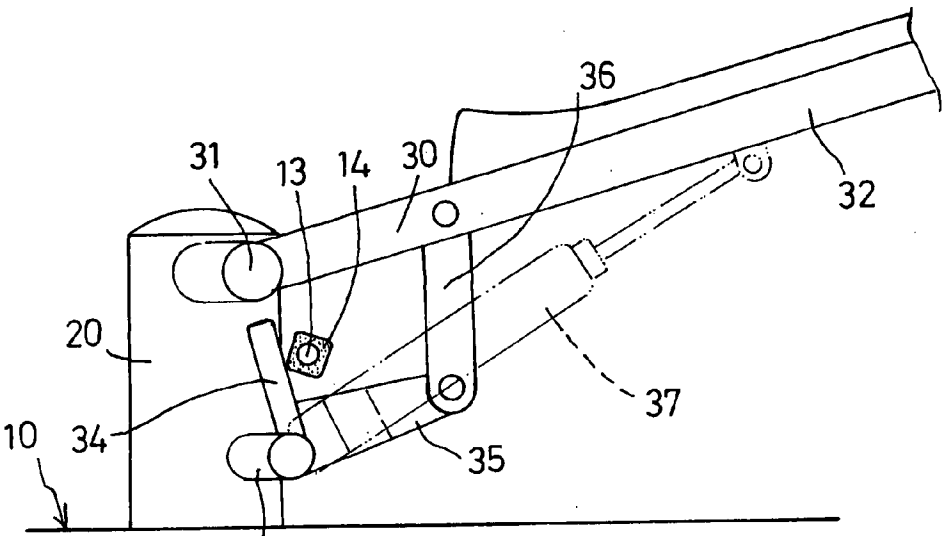
Figure 8:
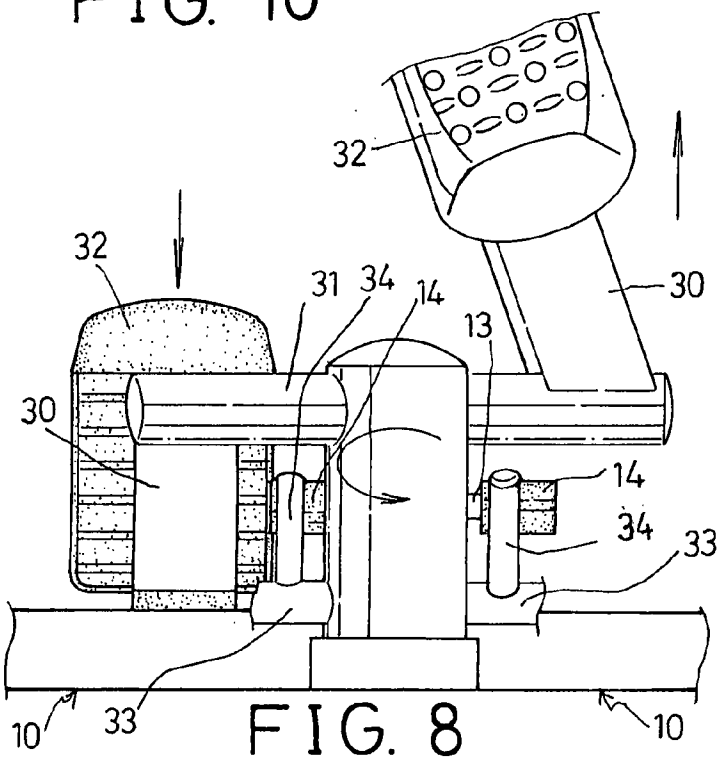
FIGS. 7, 8 are front plan views illustrating the operation of the stepping exerciser.
Figure 7:
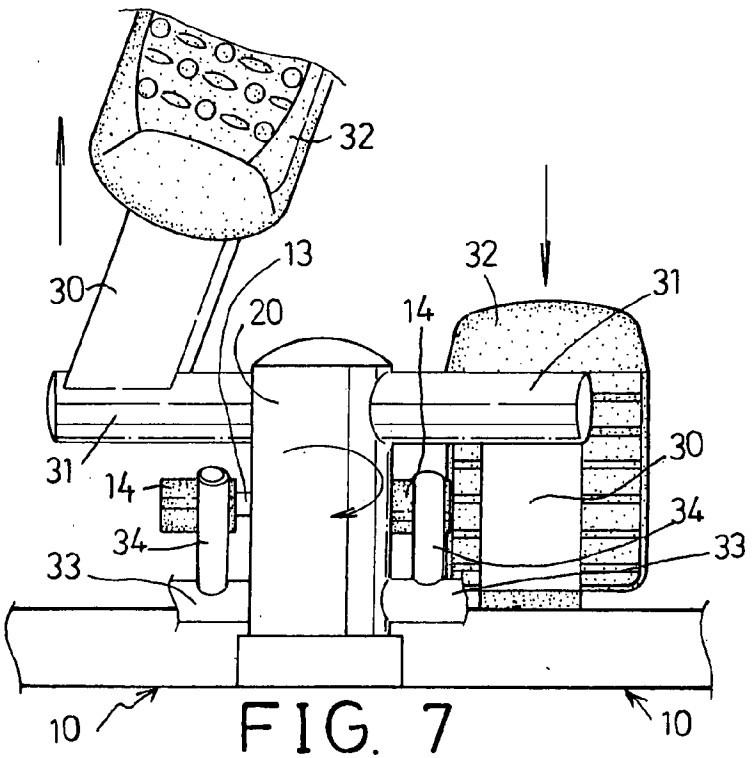

Two links 36 are coupled between the levers 35 and the foot supports 30 respectively, to couple the actuators 33 and the foot supports 30 together, and to allow the actuators 33 to be rotated relative to the base 10 about the shafts 22 by the foot supports 30 when the foot supports 30 are moved or stepped up and down by the users, best shown in FIGS. 5 and 6.

The base 10 further includes a stem 12 extended upwardly therefrom, and located close to the follower 20, and one or more, such as two seats 13 extended or provided on the stem 12, for engaging with the poles 34 of the actuators 33 respectively (FIGS. 3–10). The two seats 13 may also be taken as a single seat 13 or a one-integral seat 13 formed or provided on the stem 12 of the base 10.

It is preferable that each of the seats 13 includes an outer portion inclined forwardly toward the follower 20, or the seats 13 are inclined relative to the stem 12, best shown in FIGS. 3, 4, 9, 10, for allowing the poles 34 of the actuators 33 to stably engage with the seats 13 of the stem 12.

Figure 10:
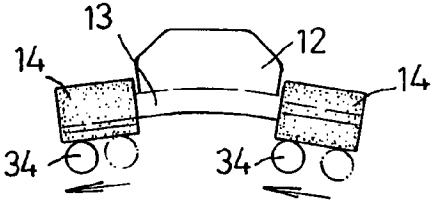
FIGS. 9, 10 are partial top plan schematic views illustrating the operation of the stepping exerciser.
Figure 9:
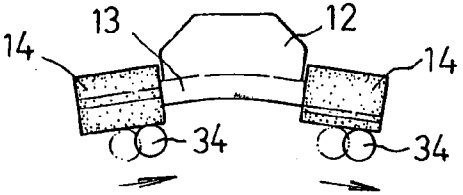

It is further preferable that each of the seats 13 includes a pad 14 engaged thereon, for resiliently or safely engaging with the poles 34 of the actuators 33, and for facilitating the sliding movement of the poles 34 of the actuators 33 relative to the seats 13 of the stem 12 (FIGS. 9, 10). Two actuators or cushioning devices 37 may be coupled between the foot supports 30 and the base 10 or the shafts 22, to apply a resistive force against the foot supports 30.

In operation, as shown in FIGS. 5–10, the actuators 33 and the poles 34 may be forced to be rotated relative to the base 10 about the shafts 22 by the foot supports 30, via the links 36 and the levers 35, when the foot supports 30 are moved or stepped up and down by the users. The poles 34 of the actuators 33 may then be engaged with the seats 13 of the stem 12 of the base 10 to force the follower 20 and thus the foot supports 30 to rotate relative to the base 10 about the spindle 11.

Figure 4:
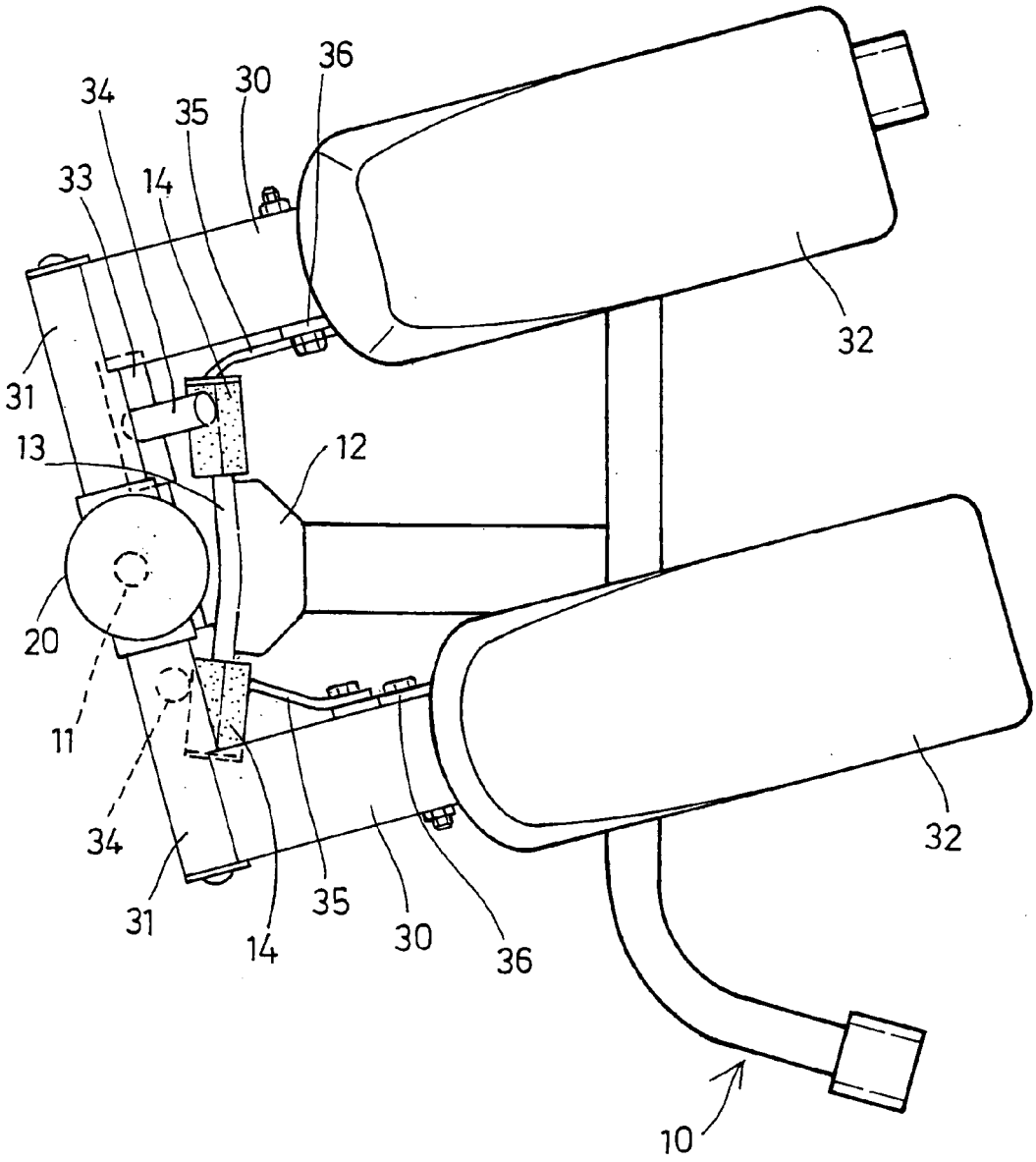
FIG. 4 is a top plan view similar to FIG. 3, illustrating the operation of the stepping exerciser.

As shown in FIG. 3, when the left foot support 30 is stepped downward, the follower 20 may be caused to rotate clockwise, to force the left foot support 30 to rotate outwardly relative to the base 10. On the contrary, as shown in FIG. 4, when the right foot support 30 is stepped downward, the follower 20 may be caused to rotate counterclockwise, to force the right foot support 30 to rotate outwardly relative to the base 10, and thus to allow the users to smoothly operate the stepping exercisers.

Figure 11:
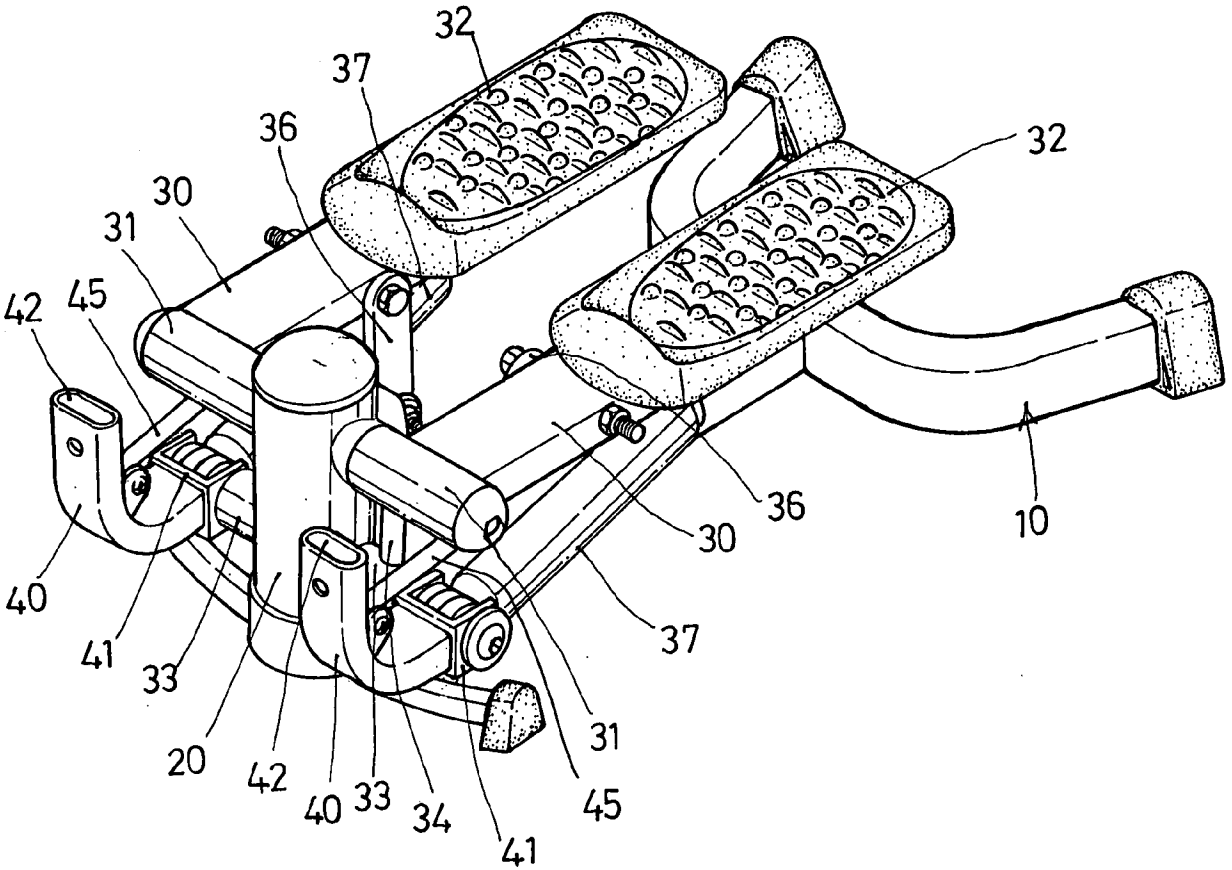
FIGS. 11, 12 are perspective views illustrating the operation of the stepping exerciser.
Figure 12:
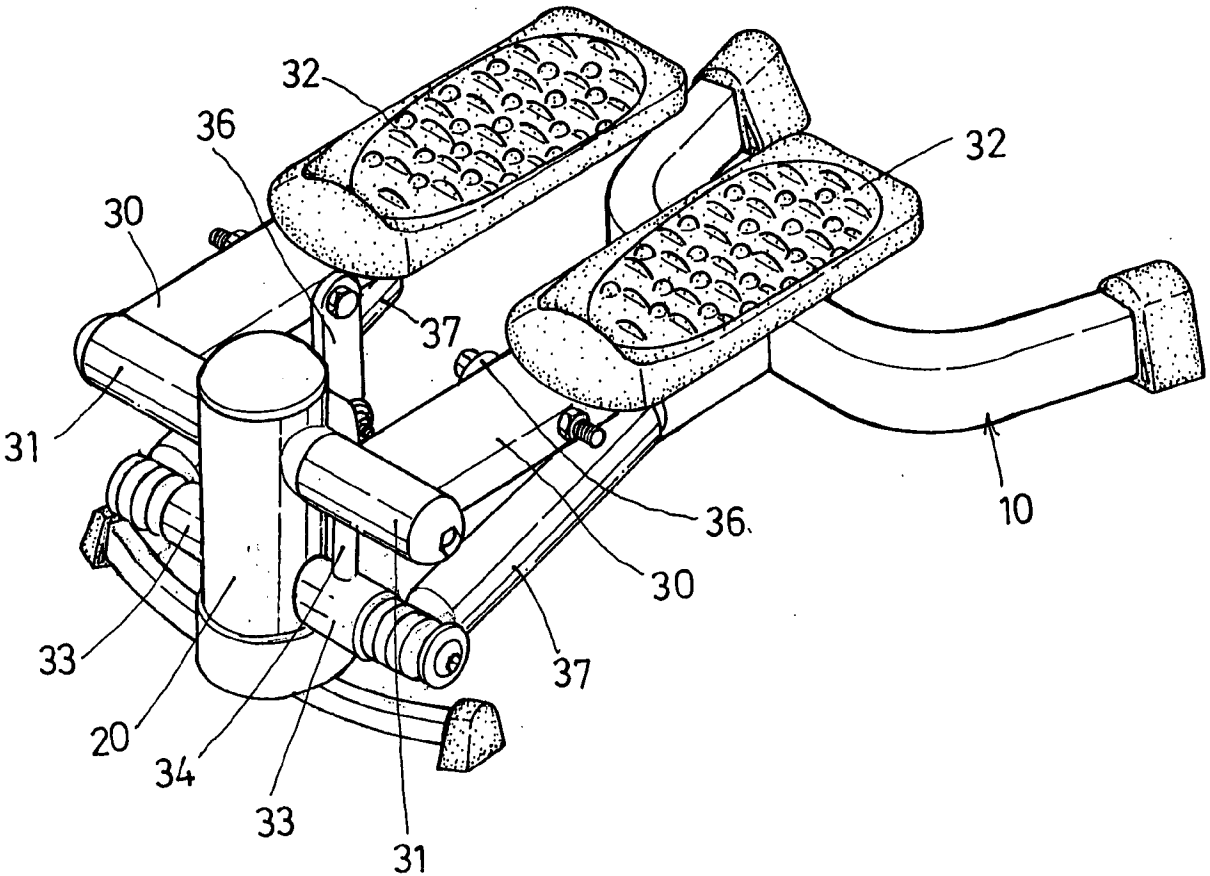

As shown in FIGS. 1, 2, and 11, two arms 40 may optionally be provided and may include a bracket 41 rotatably attached to the shafts 22 of the follower 20, and may be coupled to the foot supports 30 with a bar 45, to allow the arms 40 to be coupled to the follower 20 and the foot supports 30. Each of the arms 40 includes an opening 42 formed therein for detachably receiving a handle 43 which may be used to support the upper portions of the users.

Accordingly, the stepping exerciser in accordance with the present invention includes a rotatable mechanism for operating smoothly rotating or swinging or twisting operation while conducting stepping exercises.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising:

a base including a seat provided thereon, a follower rotatably attached to said base, and including an axle and a shaft extended therefrom, two foot supports rotatably attached to said follower with said axle, and rotatable up and down relative to said base, and rotatable relative to said base together with said follower, two actuators rotatably attached to said follower with said shaft, and rotatable relative to said base together with said follower, each of said actuators including a pole extended therefrom for engaging with said seat of said base, to force said follower to rotate relative to said base when said actuators are caused to rotate relative to said shaft of said follower, and means for coupling said foot supports to said actuators, to rotate said actuators relative to said shaft of said follower when said foot supports are rotated up and down relative to said base.

2. The stepping exerciser as claimed in claim 1, wherein said coupling means includes two levers extended from said actuators respectively, and two links coupled between said foot supports and said actuators respectively, to allow said actuators to be rotated relative to said shaft of said follower by said foot supports.

3. The stepping exerciser as claimed in claim 1, wherein said seat of said base is inclined toward said follower.

4. The stepping exerciser as claimed in claim 1, wherein said base includes a pad engaged onto said seat, for engaging with said pole of said actuator.

5. The stepping exerciser as claimed in claim 1 further comprising means for providing resistive force against said foot supports.

6. The stepping exerciser as claimed in claim 1 further comprising two handles detachably attached to said follower.

7. The stepping exerciser as claimed in claim 6, wherein said follower includes two arms attached to said shaft, to support said handles respectively.

8. The stepping exerciser as claimed in claim 7, wherein each of said arms includes a bracket rotatably attached to said shaft.

9. The stepping exerciser as claimed in claim 7, wherein each of said arms includes an opening formed therein to receive said handles respectively.

10. The stepping exerciser as claimed in claim 7, wherein each of said arms includes a bar coupled to said foot supports.

* * * * *